US006469633B1

(12) United States Patent
Wachter

(10) Patent No.: US 6,469,633 B1
(45) **Date of Patent: *Oct. 22, 2002**

(54) REMOTE CONTROL OF ELECTRONIC DEVICES

(75) Inventor: Martin Richard Wachter, Baltimore, MD (US)

(73) Assignee: Openglobe Inc., Indianapolis, IN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/002,721

(22) Filed: Jan. 5, 1998

Related U.S. Application Data

(60) Provisional application No. 60/034,014, filed on Jan. 6, 1997.

(51) Int. Cl.[7] ..... G08C 19/00

(52) U.S. Cl. ..... 340/825.69; 340/825.22; 340/825.24; 340/825.25; 340/825.72; 348/601; 348/563; 348/734; 345/158; 345/163; 345/169

(58) Field of Search ..... 340/825.22, 825.24, 340/825.25, 825.69, 825.72; 348/601, 563, 734; 345/158, 163, 169

(56) References Cited

U.S. PATENT DOCUMENTS 4,703,359 A * 10/1987 Rumbolt ..... 358/194
5,412,766 A * 5/1995 Pietras ..... 395/131
5,517,612 A * 5/1996 Dwin ..... 395/166
5,555,098 A * 9/1996 Parulski ..... 358/341
5,598,523 A * 1/1997 Fujita ..... 395/352
5,724,106 A * 3/1998 Autry ..... 348/734
5,774,063 A * 6/1998 Berry ..... 340/825.69
5,854,621 A * 12/1998 Junod ..... 345/158

OTHER PUBLICATIONS

ADCOM GFB–8000, GTP–600, and GCD–700 manuals Before 1996.
Xantech Models 282–00 and 284–00 mini emitters Installatin Instructions 1995.
Logitech Mouse and Trackball user's guide 1996 Copywrite.
JDS InfraRed Xpander user manual Aug. 1995.

* cited by examiner

*Primary Examiner*—Michael Horabik
*Assistant Examiner*—M Shimizu

(57) ABSTRACT

An apparatus controls electronic devices, via radio frequency (RF) transmitter and receiver for communication between the apparatus and a user, a central processing unit (CPU) executing software for handling the conversion of an RF signal from the user into a two dimensional location (an X, Y coordinate system) and conversion into a series of remote control commands for transmission to a series of devices equipped for remote control. The user can control the electronic devices of an electronic system, for example a home entertainment system (which might include, by way of example, a television, a DSS or satellite receiver, a CD player, a video recorder, a video disc player, a radio tuner, an amplifier, a tape deck, an audio video preamplifier or a combination of one or more of the foregoing). The CPU also executes software which digitizes real time video and combines it with computer graphics for display.

4 Claims, 10 Drawing Sheets

REMOTE CONTROL OF ELECTRONIC DEVICES

RELATED APPLICATIONS

This application is a continuation-in-part of U.S. Provisional Patent Application Ser. No. 60/034,014, filed Jan. 6, 1997.

FIELD OF INVENTION

The present invention relates in general to control of electronic devices, and in particular to a radio frequency (RF) remote controller which lets a user operate remote controllable devices using a central processing unit and graphical user interface software.

Grouping one or more electronic devices (also known as "components") has become increasingly popular and complex for the user to operate. Such groupings are variously known as "home theaters" or "home entertainment centers" in the home environment, and as "board room systems", "presentation systems", or "sales demonstration systems" in the office or business environment. The operation of these systems is similar, and will be described below with reference to a home system, although the same principles could be applied to any grouping of remote controllable electronic components.

A home entertainment center typically comprises one or more RCEDs, examples of which include a television or video projection system, a satellite or cable TV receiver, a CD player, a video recorder, a video disc player, a radio tuner, a tape deck, amplifiers, speakers, motorized devices, lighting systems, and computer systems. Each of these consumer electronic devices may be provided with a remote control or a technical specification which allows the user to operate its functions from a distance.

However, typical state of the art systems present the following complications:

1) There is no common "language" for remote control; thus, a user with multiple components must own, (and master the operation of) multiple remote controllers.
2) The user must store, relocate and protect each of these remote controllers.

This takes storage space, and the ability to manually search for the correct remote when the user wishes to control a particular device or component. This is a problem in the home as users do not want to clutter their living rooms or home theaters with dozens of remote controls or expensive bulky touchscreens. This is a problem in the business environment as a presenter does not want to fumble around in the dark searching for a remote control during a presentation. This is a problem in the retail market as the retailer must store, locate, and protect from theft each of the remote control devices.

3) Typical remote controllers contain more buttons than a human hand has digits. The typical user becomes confused by the number of commands available all at once.
4) Typical remote controllers have a limited number of one purpose buttons; a user must memorize the function of each button (for each component). In most cases, the physical location of the button and the description of the button can not be changed.
5) Typical remote controllers store infrared command codes internally in the controller itself, and transmit these codes to the component. These transmissions are line-of-sight and therefore either preclude concealment of the component or require expensive repeater systems to receive the line-of-sight transmission and retransmit the IR beam to the concealed location.
6) Typical remote controllers require the user to look at and refocus their attention on multiple objects as well as manipulate multiple remote controls.

The user must change visual focal point from the viewing of a video picture to locate the proper remote control device, put down the current remote control device, look at the remote control device and determine which button to press, then refocus on the video or audio component to determine if they pressed the correct button and determine if the desired change occurred.

SUMMARY OF THE INVENTION

The foregoing problems are overcome, and other advantages are provided by a novel apparatus and method for controlling RCEDs, comprising a radio frequency (RF) transmitter and receiver for communication between the user and the apparatus, a central processing unit (CPU) which manages radio frequency (RF) and control data, real time video input and output, and executes software for handling user commands, transmitted from the RF transmitter, and a control signal generator, which control one or a series of RCEDs.

The user of the system views a video display (typically, a TV screen or monitor of the home theater, presentation system, or sales demonstration system) which has two modes of operation: Full Screen Mode and Control Mode. Full Screen Mode is a mode that displays video on the entire video display just as one might expect video to be displayed without this invention. Control Mode is similar to the effect of a "heads up display" that a fighter pilot uses to fly, control, and monitor the status of his or her jet during operation, without having to look down at the controls or move their hands to other controls. Control Mode provides this functionality for the user of electronic devices.

In Control Mode, the CPU and software create a combined screen of real time video signal and computer generated graphics with graphic and textual "buttons" which represent a single command function or multiple command functions. In Full Screen Mode, the real time video signal occupies the entire screen. In Full Screen Mode, preferably the video signal path of the computer graphics is bypassed, thereby removing the added overhead and signal degradation of combining video signal with computer generated graphics.

It is an object of the invention to provide a control system for controlling multiple electronic components via a single user-operated remote control device.

It is a further object of the invention to provide a control system for controlling electronic devices using an on-screen graphical interface.

It is a further object of the invention to provide a control system for controlling electronic devices which are located in a concealed location.

A principal feature of the invention is communication between the user and an electronic system via RF, which does not require line-of-sight. An advantage of this feature is the ability to conceal the components of the system.

Another principal feature of the invention is to allow customization of the placement and representation of the buttons which the user triggers to control electronic devices. An advantage of this feature is that each user can have the commands ordered and depicted in a familiar layout or pattern. Textual buttons can be labeled in multiple languages.

Another principal feature of the invention is to allow the user to operate the entire system using one hand. An advantage of this feature is to allow the user to use the other hand for an additional task.

Another principal feature of the invention is to allow the user to operate the entire system without looking away from the video monitor or TV. An advantage of this feature is to allow the user to concentrate and focus on the audio and video content, and not the physical location of the remote command buttons.

Another principal feature of the invention is software and hardware which permits automated training of the system, i.e., automated acquisition of the codes necessary to control the various electronic devices into a single unit. An advantage of this feature is simplicity of setup and the ability to learn the commands of new components which may exist in the future.

These and other objects, features and advantages which will be apparent from the discussion which follows are achieved, in accordance with the invention, by providing a novel apparatus and method for controlling electronic devices, comprising a radio frequency ("RF") transmitter and receiver for communication between the user and the apparatus, a central processing unit (CPU) which manages radio frequency ("RF") and control data, real time video input and output, and executes software for handling user commands, transmitted from the RF transmitter, and a control signal generator, which control a series of electronics devices which are equipped for remote control.

The various features of novelty which characterize the invention are pointed out with particularity in the claims annexed to and forming a part of this disclosure. For a better understanding of the invention, its advantages and objects, reference is made to the accompanying drawings and descriptive matter in which a preferred embodiment of the invention is illustrated.

BRIEF DESCRIPTION OF THE DRAWINGS

The foregoing and still other objects of this invention will become apparent, along with various advantages and features of novelty residing in the present embodiments, from study of the following drawings, in which.

DESCRIPTION OF THE PREFERRED EMBODIMENT

The invention is a novel apparatus and method for controlling electronic devices, comprising a radio frequency (SERFS) transmitter and receiver for communication between the user and the apparatus, a central processing unit (CPU) which manages RF and control data, real time video input and output, and executes software for handling user commands, transmitted from the RF transmitter, and a control signal generator, which control a series of electronics devices which are equipped for remote control.

The novel apparatus and method for controlling remote controllable electronic devices ("RCEDs"), comprises an RF transmitter/receiver 1 a central processing unit (CPU) 2 executing software for handling the conversion of an RF signal from the user into a two dimensional location (an X, Y coordinate system) and conversion into a series of remote control commands for transmission to one or a series of control signal generators, for example an infrared transceiver 7 for controlling one or a series of RCEDs 3, enabling a user to control the RCEDs 3, by way of example, those found in a home entertainment system (including, by way of further example, a television, a DSS or satellite receiver, a CD player, a video recorder, a video disc player, a radio tuner, an amplifier, a tape deck, an audio video preamplifier or a combination of one or more of the foregoing).

The principles may be applied to a wide variety of electronic component configurations, but can be illustrated with respect to a sample configuration of a home theater system which has been constructed as a prototype.

Figure 1:
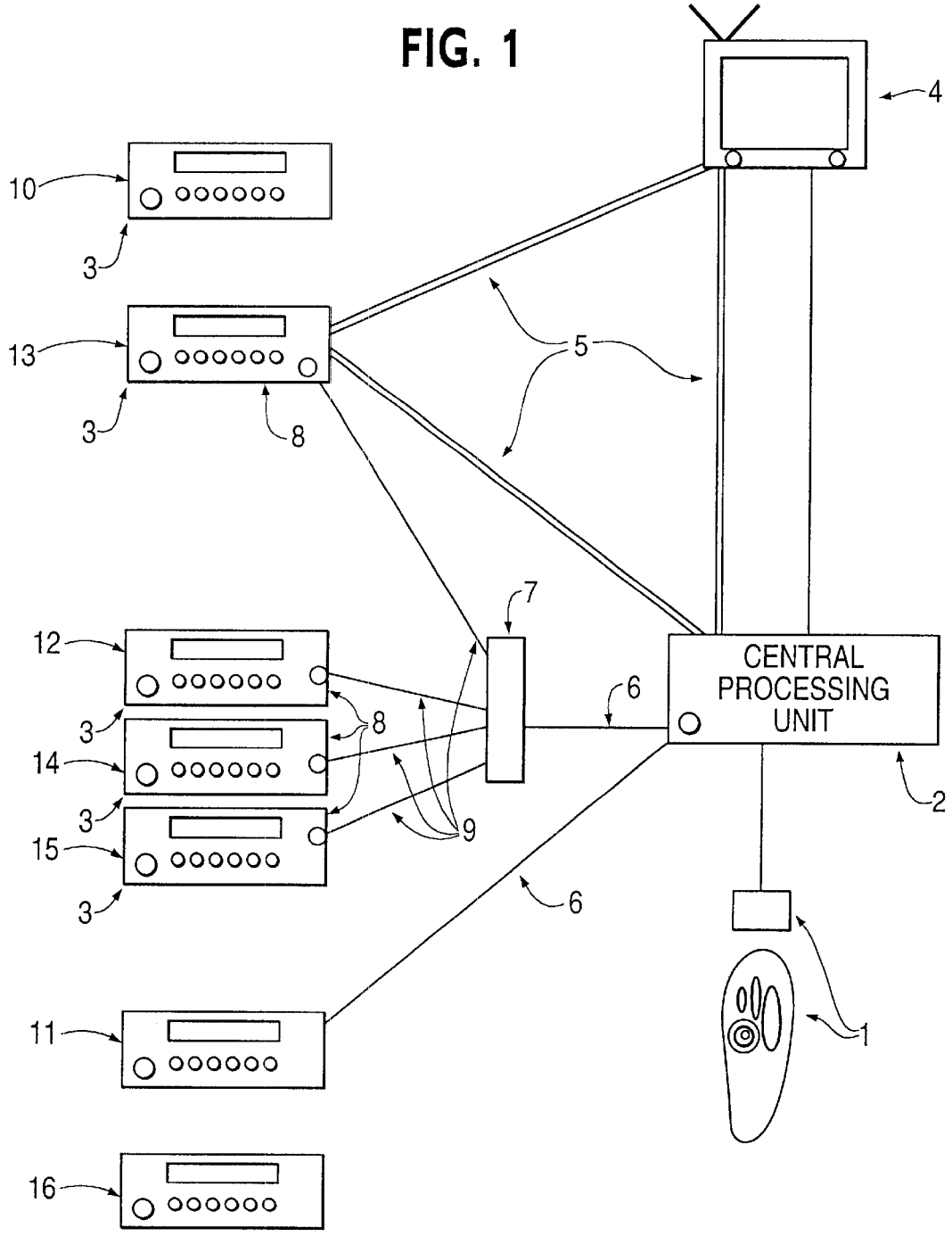
FIG. 1 is a schematic diagram of the components of an embodiment of the invention.
Figure 2:
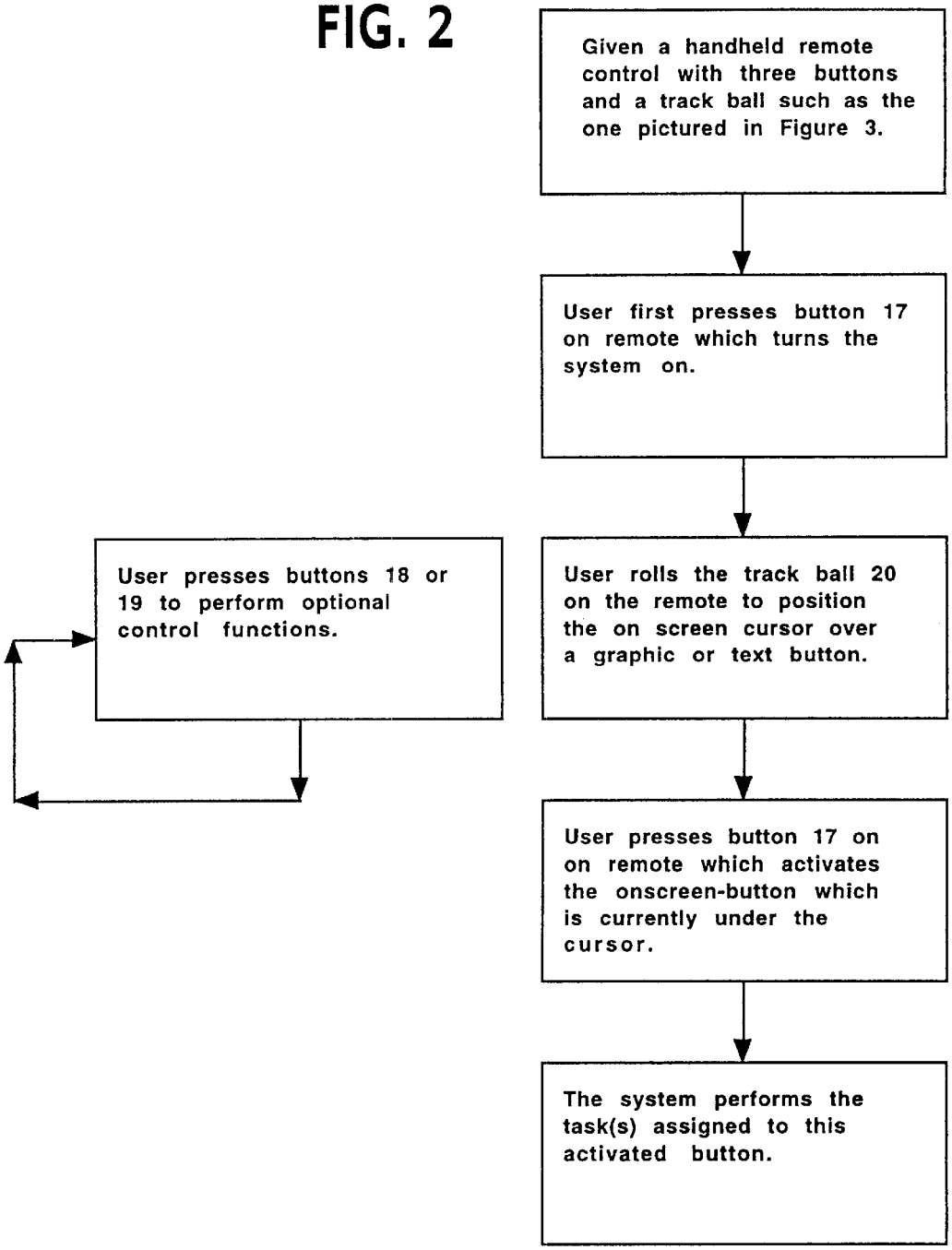
FIG. 2 is a flow chart of the basic steps of operating an embodiment of the invention.
Figure 3:
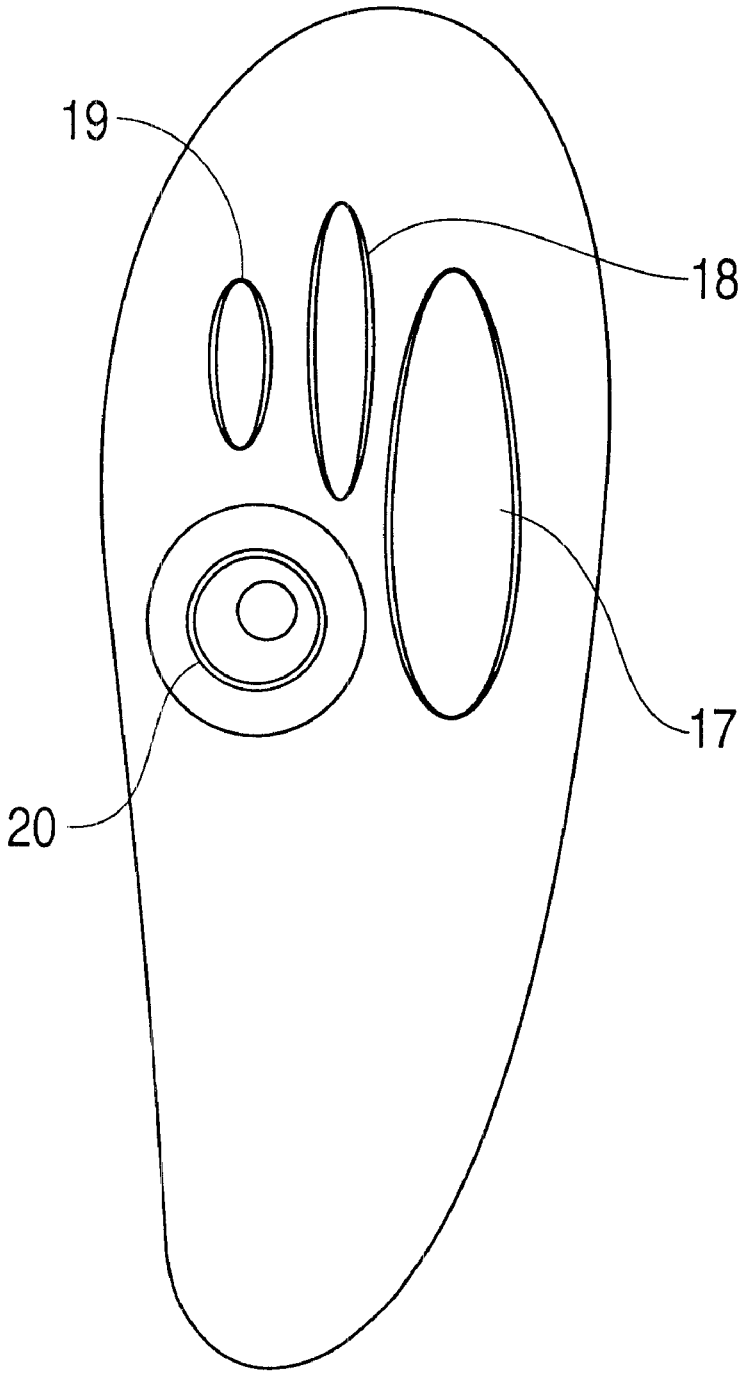
FIG. 3 (PRIOR ART)
FIG. 3 is an illustration of a prior art controller suitable for use with the invention.
Figure 4:
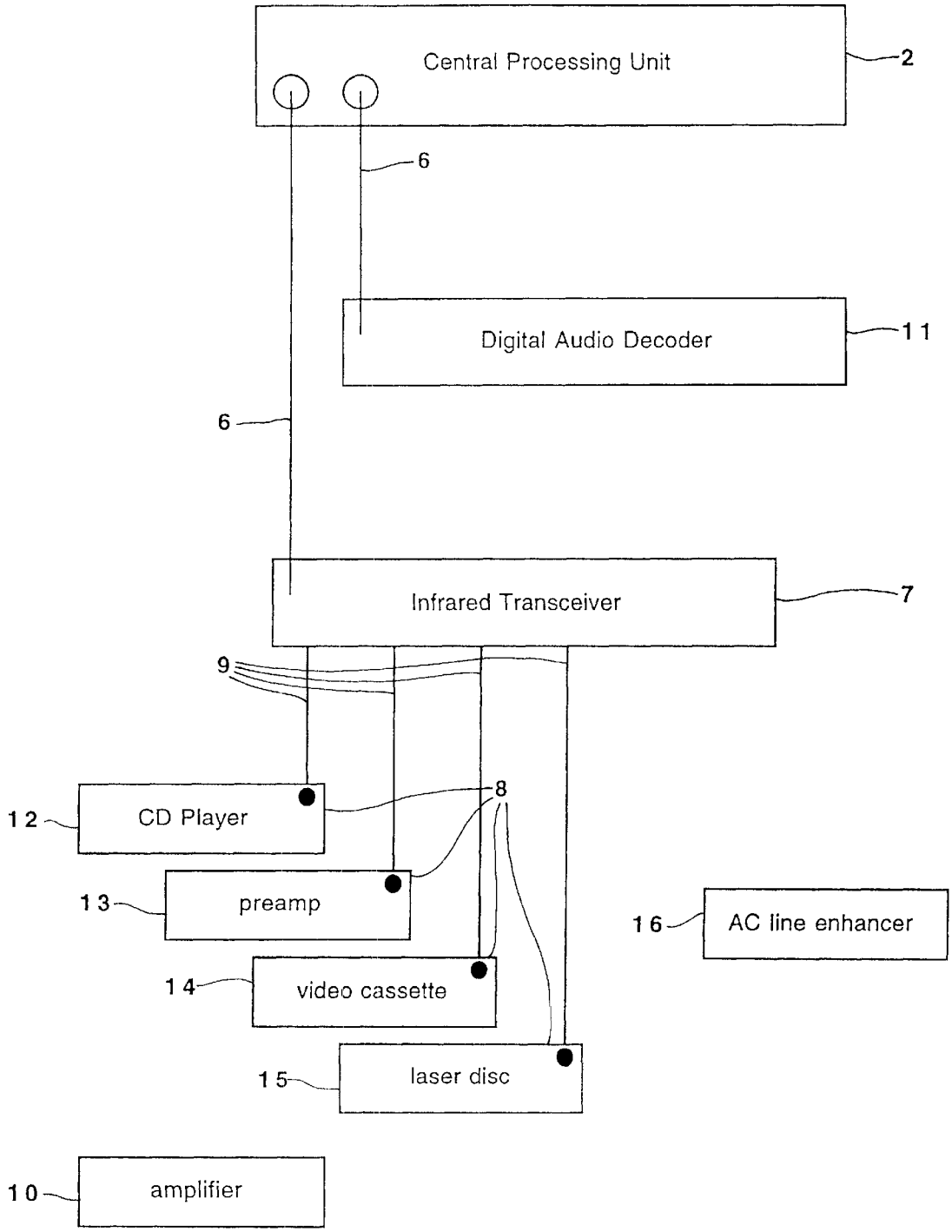
FIG. 4 is a schematic diagram of a typical configuration of the control and connections to enable infrared remote control and serial remote control of components.
Figure 10:
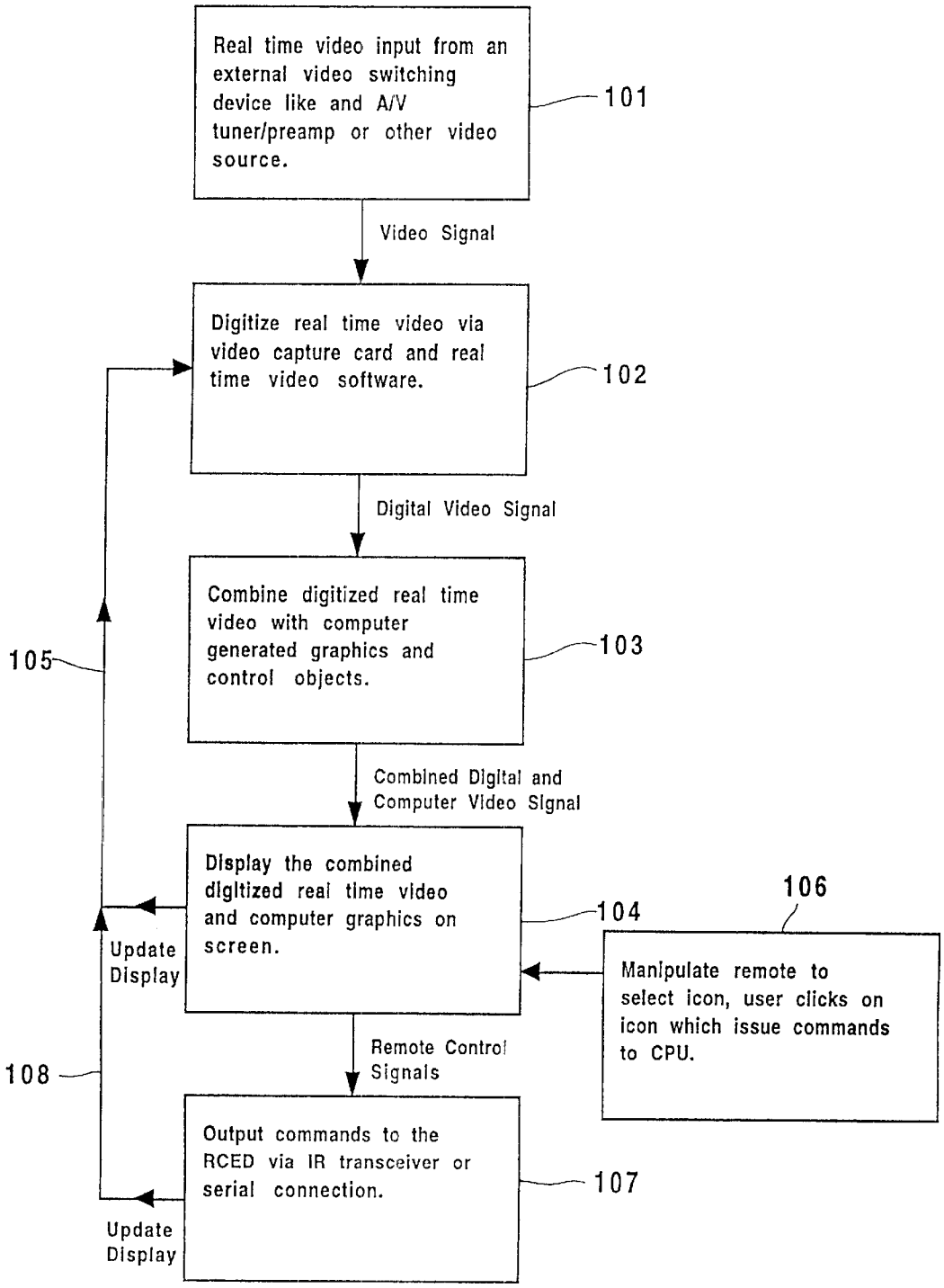
FIG. 10 is a flow chart of software suitable for controlling a CPU implement the invention.

Referring to the drawings, the invention as shown in overview in FIG. 1 comprises an RF transmitter/receiver 1 for communication between the user and a central processing unit (CPU) 2 executing software [a flow chart of which is shown in FIG. 10 which manages radio frequency ("RF") and control data, real time video input and output communicated over video cable 5, and handles user commands, transmitted from the RF transmitter/receiver 1, to activate a control signal generator 7, which control a series of RCEDs 3 and was implemented in the prototype using a monitor 4 of a home theater system, under software control to offer two on-screen display modes which are selectable by the user: Full Screen Mode, and Control Mode.

The prototype consisted of the components illustrated in FIG. 1, i.e.:

RF Transmitter/Receiver 1 was a Logitech TrackMan (R) Live! (TM) ADB cordless mouse RF transmitter (Model No. B3P/N—804125-00=B2 was used in the prototype) and Logitech TrackMan (R) Live! (TM) RF receiver (Model No. 10 B3P/N—811339-0000 was used in the prototype) RF transmitter/receiver 1 was coupled to via a mouse port to computer (CPU) 2 which maybe a MACINTOSH® CPU, e.g. a 660 av with 8 megabytes of RAM and 80 megabyte hard drive. Any CPU with adequate processing speed for realtime video I/O, and ample RAM and hardy disk space for the operating system, the control software and their associated files may be used.

CPU 2 also requires support components according to the particular implementation, all of which could be selected by one of ordinary skill in the art. A PowerMac™ 7200/75, available from Apple Computer, with an XCLAIM™ VR 2 megabyte video card, available from ATI, are examples.

CPU 2 executes software implementing the instructions set forth in the flow chart of FIG. 10. The software may be a program written in C++ compiled using e.g., a Metrowerks CodeWarrior™ C++ compiler. Source and executable code is stored in a self-extracting compressed file on the Macintosh formatted disk attached to this application.

CPU 2 is coupled via serial cable 6 from the serial port of the CPU 2 and the input of IR transceiver 7.

IR transceiver 7 had, in the prototype, 4 dual IR emitters, but in general must be capable of controlling a suitable number of IR emitters 8 selected according to the design of the overall system, and coupled to RCEDs via IR cable 9.

RCEDs may be home theater components of the user's selection, each having an IR or serial control. The prototype consisted of the following components:

Amplifier 10 (in the prototype, Adcom GFA-7000 THX 5 channel power amps).

Controller signal generator 7 (in the prototype, Macintosh 7200 CPU with ATI video I/O card, JDS IRXP2 transceiver, JDS Power sensor input connecting block, Smartlinc power sensors, Xantech IR emitters, and Logitech Trackman Live for Macintosh).

Digital decoder 11 (in the prototype, Adcom BOS-510 Dolby (R) digital decoder), CD player 12 (in the prototype, Adcom GCD-700 five disc CD player).

Tuner-preamp 13 (in the prototype, Adcom GTP-600 tuner preamp A/V switcher, Dolby® Pro Logic® decoder).

Video cassette deck 14 (in the prototype, Yamaha YV-700 video cassette deck).

Laser disc player 15 (in the prototype, Marantz Multi Laser disc player LV 520 RCA DSS model DS7430RA).

AC line switcher/enhancer 16 (in the prototype, Adcom ACE-515 AC Line switcher and enhancer).

Monitor 4 (in the prototype, Sharp H37U LCD video projector and Draper PermaWall 100 screen).

By With the prototype so constructed, operation is as follows.

CPU 2 executes suitable software, such as that summarized in the flow chart in FIG. 10, one suitable embodiment of which is provided on disc as an attachment to this application. The software generates a graphical user interface which is displayed on the monitor 4 and can be operated using an RF mouse as RF transmitter/receiver 1. The user interface comprises two modes: Full Screen Mode and Control Mode. In Full Screen Mode, the software displays a video signal which occupies the entire screen. (In Full Screen Mode, preferably the video signal path of the computer graphics is bypassed, thereby removing the added overhead and signal degradation of combining video signal with computer generated graphics.)

Starting in Control Mode, a real time video input is provided 101 and digitized 102 and combined with other video such as computer generated graphics or icons generated 103 by CPU 2 and displayed 104 on monitor 4. FIGS. 5–9 illustrate samples of suitable GUI displays created by the software. The user selects which task to perform by looking at the monitor 4 and manipulating a single remote control in one hand. By utilizing simple hand-eye coordination, the user manipulates an on screen cursor over a graphical icon or text button, and CPU 2 continuously updates 105 display on monitor 4 until user the clicks the remote which triggers 106 the command or commands associated with the selected icon or text button.

As illustrated in FIGS. 5–9, the graphical user interface includes a lists of texts buttons on the left and right of the video area that are the same in all of FIGS. 5–9 and a three by seven array of icons or text buttons below the video area which are not the same in FIGS. 5–9. To the left of the video area is a source list indicating components that can be controlled. To the right of the video area is a global list of operations that does not change as different sources are selected. Below the video area is a control grid of 21 positions in a three by seven array which changes depending on which source is selected in the source list.

Figure 5:
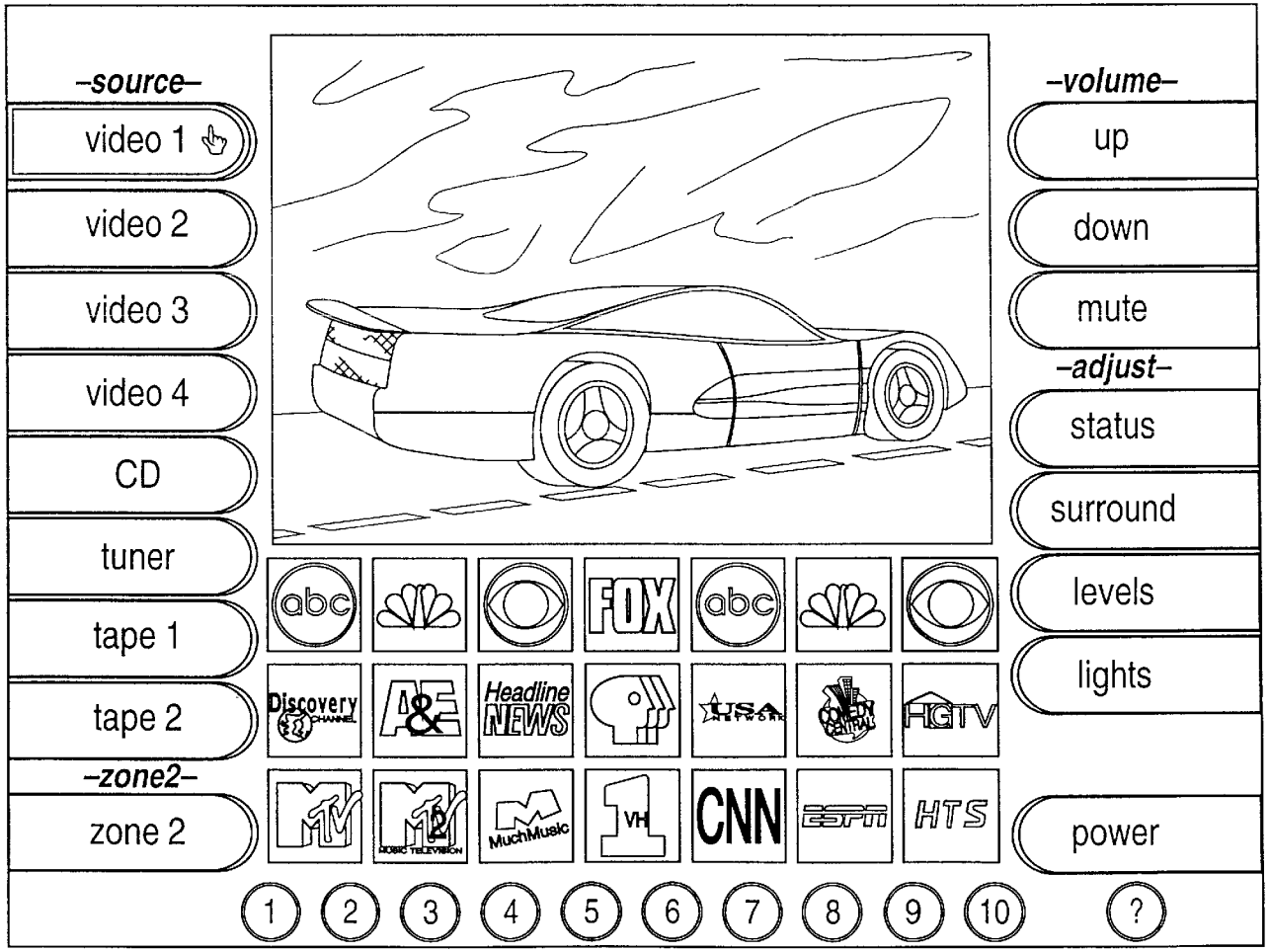
FIGS. 5–9 illustrate sample GUI screen displays.

When "video 1" is selected as illustrated in FIG. 5, the control grid displays buttons corresponding to television channels available for viewing. As can be seen in FIG. 5, the logos of the networks, whether conventional broadcast, cable or satellite can be used for easy identification by the user.

Figure 6:
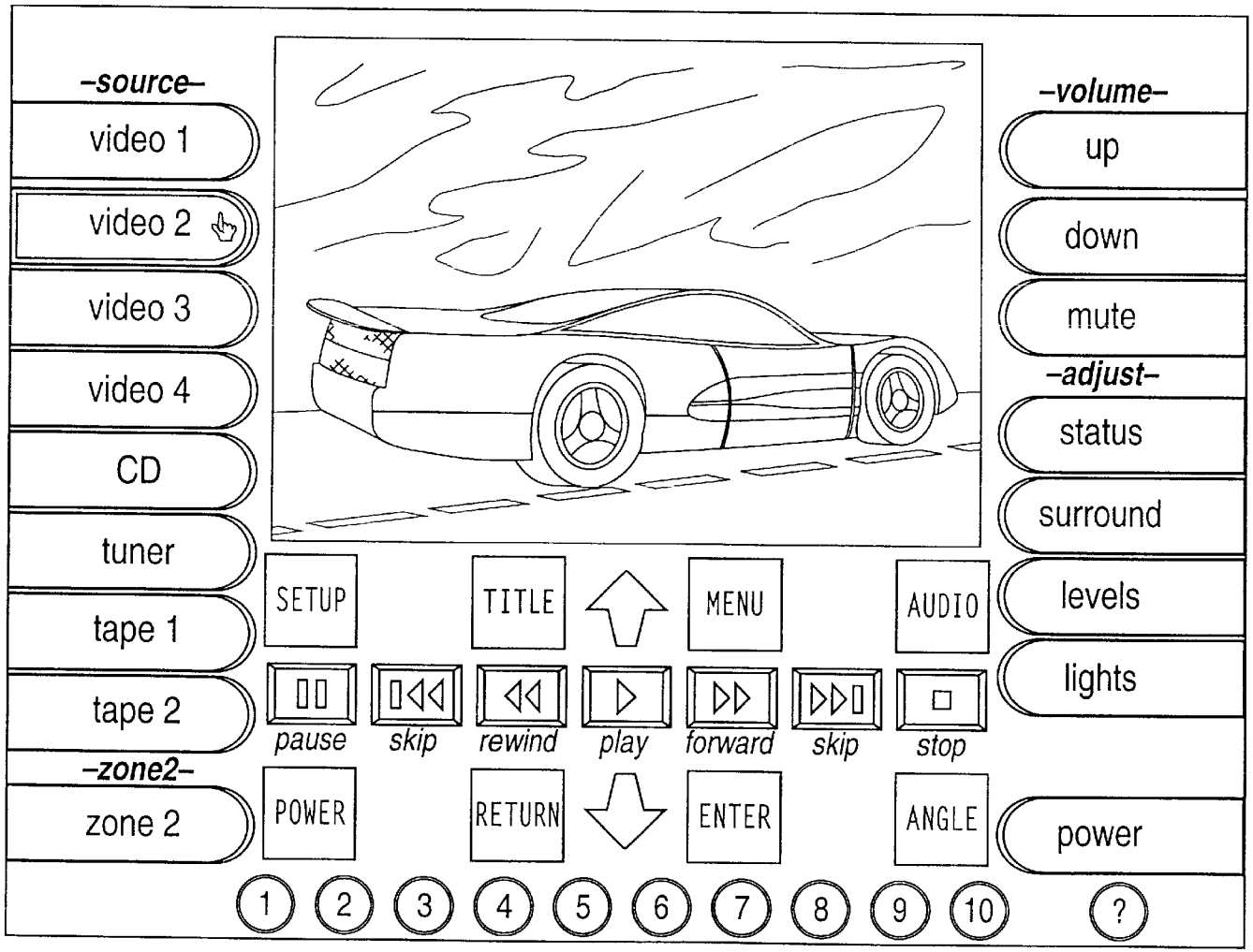
Figure 7:
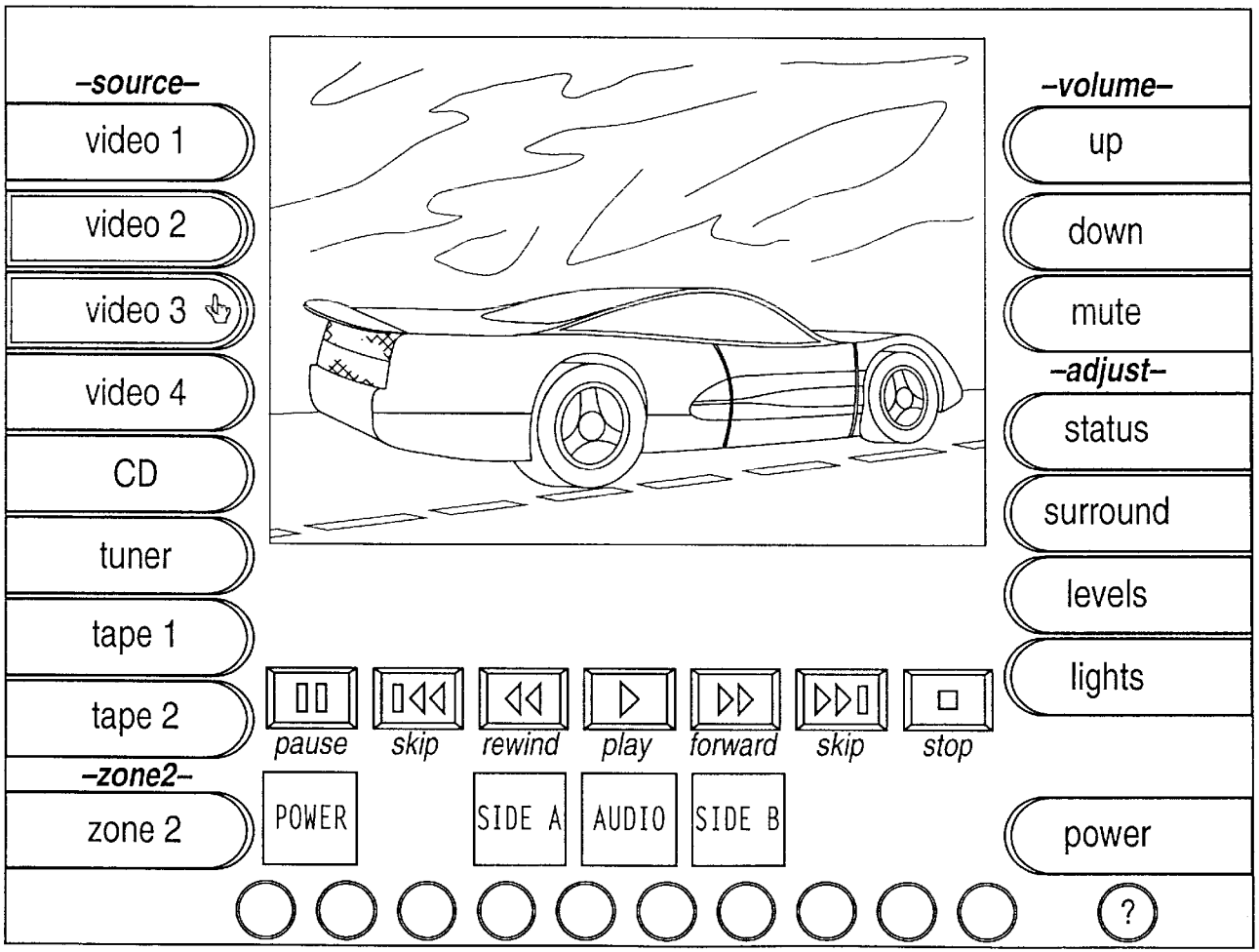
Figure 8:
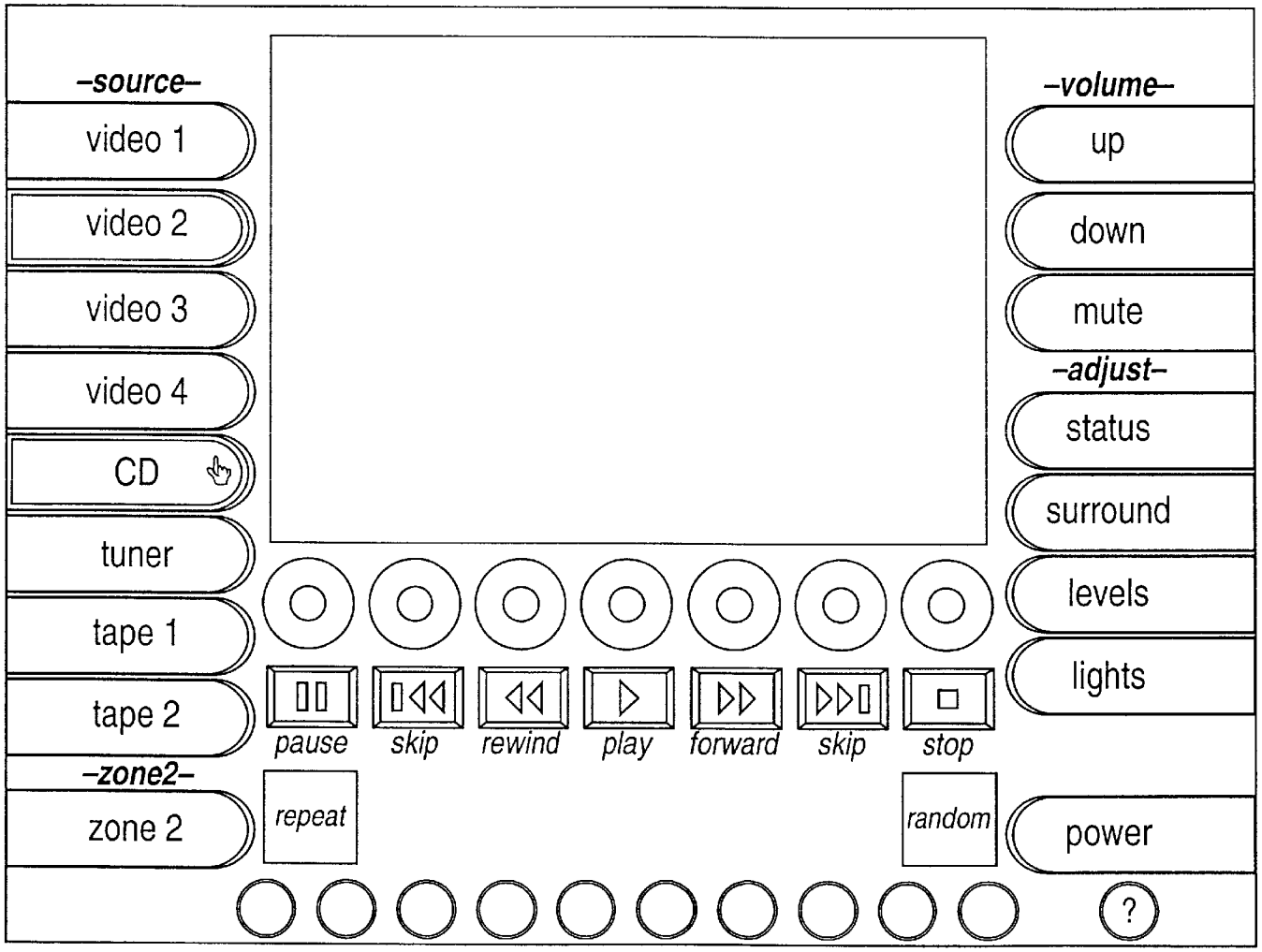
Figure 9:
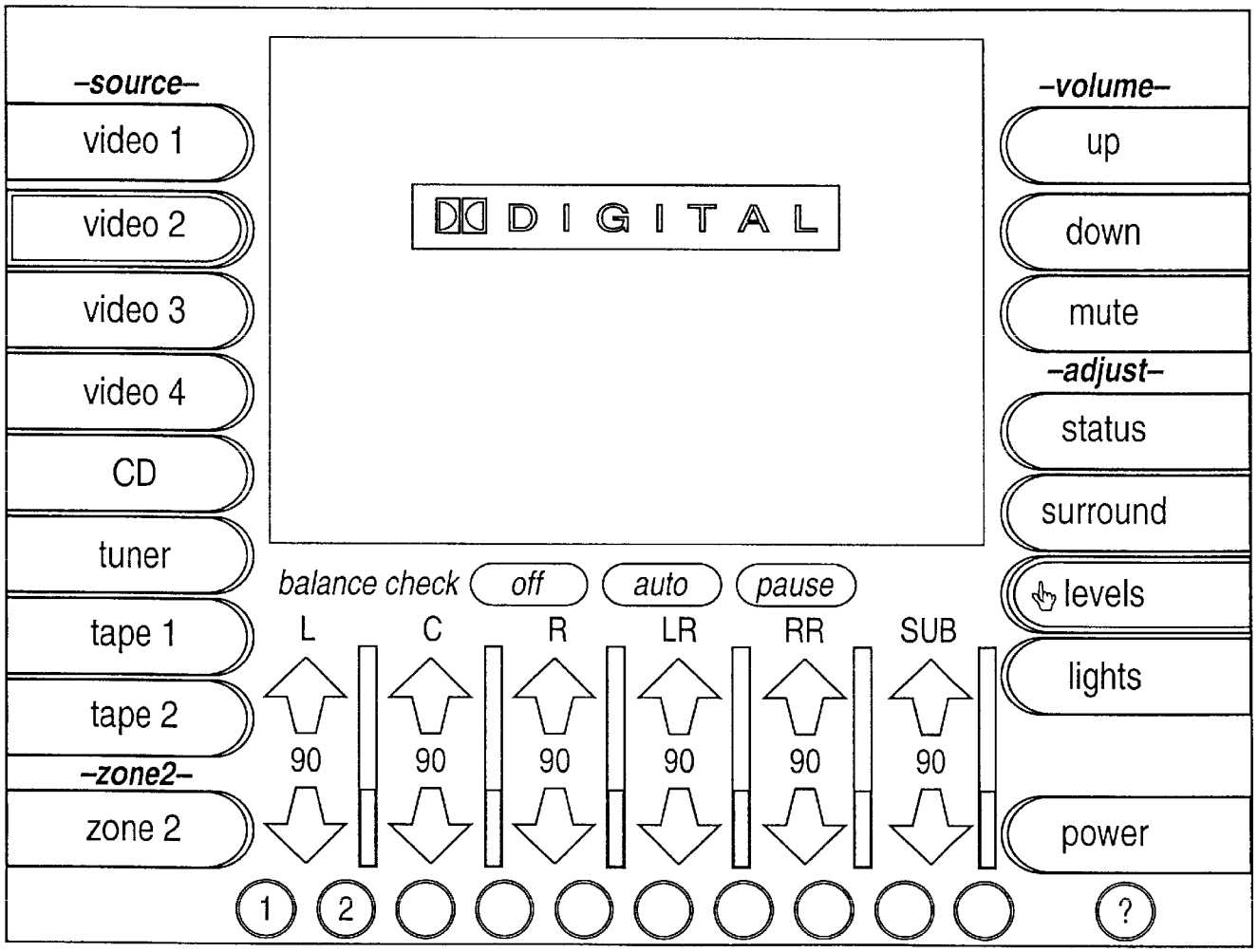

As described above, many different playback devices, such as video and audio tape decks, and CD and laser disc players can be controlled by the CPU 2. Examples of the graphical user interface for different kinds of playback devices are illustrated in FIGS. 6–8. When "video 2" is selected as illustrated in FIG. 6, buttons like those used to control a digital versatile disc (DVD) player are displayed in the control grid, as indicated by the buttons labeled TITLE, MENU and ANGLE. When "video 2" is selected as illustrated in FIG. 7, buttons like those used to control a laser disc player are displayed in the control grid, as indicated by the buttons labeled SIDE A and SIDE B. When "CD" is selected as illustrated in FIG. 8, buttons like those used to control a compact disc player are displayed in the control grid, together with disc selection icons (in the prototype described above the CD player was a five disc changer).

It should be noted that since the CPU [2] responds to user commands according to the location of a cursor, each button may be custom located for each user, so as to provide visual cues as to the function to be selected, thereby eliminating the need to memorize the location of the function for each different source component. For example, buttons that represent the PLAY function for three different components such as a CD player, a tape player, and a video disc player can all be located at the same location on the screen such as the center. This allows the user to become familiar with the placement of the button that issues a PLAY command regardless of the currently selected source component. In this example, the PLAY button is always in the center.

In addition, similar icons can be used for similar functions. As illustrated in FIGS. 6–8, the pause, skip (back), rewind, play, (fast) forward, skip (forward) and stop buttons are identical for all of the selected playback devices, as well as being located in the same positions. This is in addition to the volume and "adjust" buttons consistently displayed in the global list on the right of the video area, regardless of which source device is selected.

In step 107, CPU interprets the user's selection by reference to the two dimensional position (X, Y coordinate system) of the on-screen cursor, and the on screen button located at this coordinate will be executed by generating a control signal to the appropriate RCED or RCEDs via the appropriate control cable. RCEDs typically require infrared control or serial control. In the case of infrared controlled devices, the infrared code is sent from the CPU 2 to the device via IR cable 9 which has an infrared emittter 8 such as a light emitting diode (LED) or direct infrared injector plug on the terminating end, depending on the manufacturer's hardware configuration of the device. The device responds to the issued command just as if it were sent from its own infrared remote controller. In the case of serial control, a control signal is sent from the CPU to the device via a control cable connection 6. The exact commands that are sent are dependent upon the manufacturers definition of the "language" or commands that the device accepts. These commands are typically made up of ASCII text commands and are sent via industry standard RS-232 or similar two way serial control specifications via one of the CPU's serial ports. Serial control can be one or two way. Two way communication is preferable as the system can make intelligent decisions based upon the state or status of a device or component. The display on monitor 4 is then updated 108, thereby providing visual feedback to the user.

Multiple or single commands can be setup to control the internal aspects of the hardware and/or software system, and/or perform remote control of any or all of the system components.

Since the Control Mode is not visible to the user at this time, frequently used commands are available to the user via a few buttons [18 and 19] on the same remote control. This allows important and frequent commands such as but not limited to adjusting the volume level up or down, to be issued while in Full Screen mode.

The user returns to Control Mode by clicking the same button [17] that they clicked to enter Full Screen mode.

Further details of the specification of the components and the methods of their setup, connection and operation, may be found in the following manuals which are attached to the IDS filed herewith and are included herein by reference:

Logitech Mouse and Trackball for Macintosh and Compatibles User's Guide.

ADCOM 1996 Product Specifications

ADCOM GTP-600 Surround Sound Tuner/Preamp Owner's Manual

ADCOM GCD-700 CD Player Owner's Manual

ADCOM GFB-800 Operating Instructions

JDS Infrared Xpander User Manual

SHARP XV-H37U LCD Video Projector spec sheet

Thus there has been described a novel apparatus and method for controlling electronic devices comprising a radio frequency transmitter and receiver for communication between the user and the apparatus, a central processing unit (CPU) which manages radio frequency and control data, real time video input and output, and executes software for handling user commands, transmitted from the RF transmitter, which control a series of electronic devices which are equipped for remote control, and a control signal generator, that has a number of novel features, and a manner of making and using the invention.

The foregoing prototype illustrates the construction and use of the invention, but the system and methodology of the invention are adaptable to a wide range of component configurations. Other devices which have any form of remote control can be similarly controlled, as for example X-10 power line devices and security systems, telephony systems, lighting controllers, motorized electronic devices such as window coverings, speakers, and projection screens, or electronic relay systems.

While a specific embodiment of the invention has been shown and described in detail to illustrate the application of the principles of the invention, it will be understood that the invention may be embodied otherwise without departing from such principles as that various modifications, alternate constructions, and equivalents will occur to those skilled in the art given the benefit of this disclosure. Thus, the invention is not limited to the specific embodiment described herein, but is defined by the appended claims.

I claim:

1. An apparatus controlling at least one electrical device, comprising:

a display device to display representations of controls for a currently selected device and one of video signals from the currently selected device and a representation of the currently selected device;

a remote control transmitter, including a user interface consisting of only a cursor moving control and buttons to select one of icons and text displayed on said display device and what is displayed at a cursor position, to transmit a user generated signal indicating selection of a position on said display device corresponding to a selected control representation;

a remote control receiver to receive the user generated signal from said remote control transmitter;

a processor, coupled to said remote control receiver, to determine the position on said display device selected by the user generated signal and control operations corresponding thereto; and a device controller, coupled to said processor and the at least one electrical device, to control operation of the at least one electrical device in accordance with the control operations corresponding to the position selected by the user generated signal.

2. A method of interfacing with remotely controllable playback devices, including at least two of an audio tape deck, a video tape deck, an audio disc player and a video disc player, comprising:

generating on a first portion of a display area produced by a display device, a video display using one of video signals from a currently selected device included in the remotely controllable devices and a representation of the currently selected device; and displaying representations of operational commands to control the currently selected device on the display device in a second portion of the display area separate from the first portion, including displaying the video signals from one of the video tape deck and the video disc player when selected as the currently selected device;

displaying an image indicating that a non-video device is the currently selected device when one of the audio tape deck and the audio disc player is selected; and displaying representations of at least pause, play and stop in substantially identical positions on the control grid when the currently selected device is any of the playback devices.

3. A method of interfacing with remotely controllable devices, comprising:

generating on a first portion of a display area produced by a display device, a video display using one of video signals from a currently selected device included in the remotely controllable devices and a representation of the currently selected device; and displaying representations of operational commands to control the currently selected device on the display device in a second portion of the display area separate from the first portion;

receiving remote control signals from a user identifying a selected position within the display area; and switching between a control mode produced by said generating and said displaying of the representations of the operational commands and a full screen mode produced by routing the video signals without conversion from the currently selected device to display on all of the display area, in response to one of the remote control signals without selection of an icon.

4. A method as recited in claim 3, further comprising controlling the currently selected device in accordance with one of the operational commands when the selected position corresponds to the representation of the one of the operational commands.

* * * * *